US006326870B1

(12) United States Patent
Larranaga et al.

(10) Patent No.: US 6,326,870 B1
(45) Date of Patent: Dec. 4, 2001

(54) REMOTE OPERATING APPARATUS AND METHOD FOR A CIRCUIT BREAKER HANDLE

(75) Inventors: Javier I. Larranaga, Bristol; Joseph Criniti, New Britain; Farshid Attarian, Collinsville, all of CT (US); Alberto Figueroa, San Juan, PR (US); Kevin Fuhr, Goshen; Joseph B. Kelaita, Bristol, both of CT (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/638,946

(22) Filed: Aug. 15, 2000

Related U.S. Application Data

(60) Provisional application No. 60/150,770, filed on Aug. 26, 1999.

(51) Int. Cl.[7] ..... H01H 3/00; H01H 9/00; H01H 51/00

(52) U.S. Cl. ..... 335/68; 335/14; 335/71

(58) Field of Search ..... 335/14, 20, 167–176, 335/68–74

(56) References Cited

U.S. PATENT DOCUMENTS 817,031 * 4/1906 Zweigbergk ..... 335/68
1,399,496 * 12/1921 Krantz ..... 335/68
3,171,920 * 3/1965 Klein et al. ..... 335/20
4,164,719 * 8/1979 Young et al. ..... 335/14
5,323,131 * 6/1994 Castonguay ..... 335/68

OTHER PUBLICATIONS

Product Literature from Trombetta Corporation for P/Q 500 Series Solenoids, 1996 (No month).

* cited by examiner

*Primary Examiner*—Lincoln Donovan
(74) *Attorney, Agent, or Firm*—Cantor Colburn LLP; Carl B. Horton

(57) ABSTRACT

A device is provided for operating a circuit breaker handle. The device includes a body having a receiving area to receive and engage a portion of the circuit breaker handle. The body is fixedly secured to a shaft for movement between a first position and a second position. The body is caused to move by a forces from a first coil and a second coil. The first coil generates a first force in a first direction, and the second coil generates a second force in a second direction, wherein the second direction is opposite to the first direction. The first and second forces are transferred to the shaft for effectuating movement between the first and second positions.

20 Claims, 6 Drawing Sheets

REMOTE OPERATING APPARATUS AND METHOD FOR A CIRCUIT BREAKER HANDLE

CROSS-REFERENCE TO RELATED APPLICATIONS

This application claims the benefit of U.S. Provisional Application Ser. No. 60/150,770 filed on Aug. 26, 1999, which is hereby incorporated by reference.

BACKGROUND OF THE INVENTION

The present invention relates remote operating devices, and more particularly to remote operating devices for circuit breaker handles.

TECHNICAL FIELD

Remote operating devices allow movement from an "ON" or an "OFF" position of circuit protection devices by remote signaling. With typical configurations of operating mechanisms within circuit protection devices, this requires a high-speed and high-torque force applied to a handle of to reposition springs within the operating mechanism. An electric motor is commonly used to actuates a mechanism such as a ball screw and nut assembly. The mechanism transfers motion to turn a handle of the circuit protection device to the "ON" or "OFF" position. The motor operating device is signaled by a remote programming device, generally by a wired signal.

While existing remote operating devices are suitable for their intended purposes, there still remains in need for improvements, particularly related to energy requirements, speed, cost, and reliability.

SUMMARY OF THE INVENTION

An electrically actuated device generates a force required to turn a circuit protection device from the "ON" or "OFF" position. This device is a replacement of electric motors used to provide the force to move a circuit protection device handle.

The device includes a body having a receiving area to receive and engage a portion of the circuit breaker handle. The body is fixedly secured to a shaft for movement between a first position and a second position. Movement is effectuated by forces in opposite directions transmitted to the shaft provided from a pair of coils.

The above discussed and other features and advantages of the present invention will be appreciated and understood by those skilled in the art from the following detailed description and drawings.

BRIEF DESCRIPTION OF THE DRAWINGS

Referring now to the drawings, which are meant to be exemplary not limiting, and wherein like elements are numbered alike in the several Figures.

DESCRIPTION OF THE PREFERRED EMBODIMENT

Figure 1:
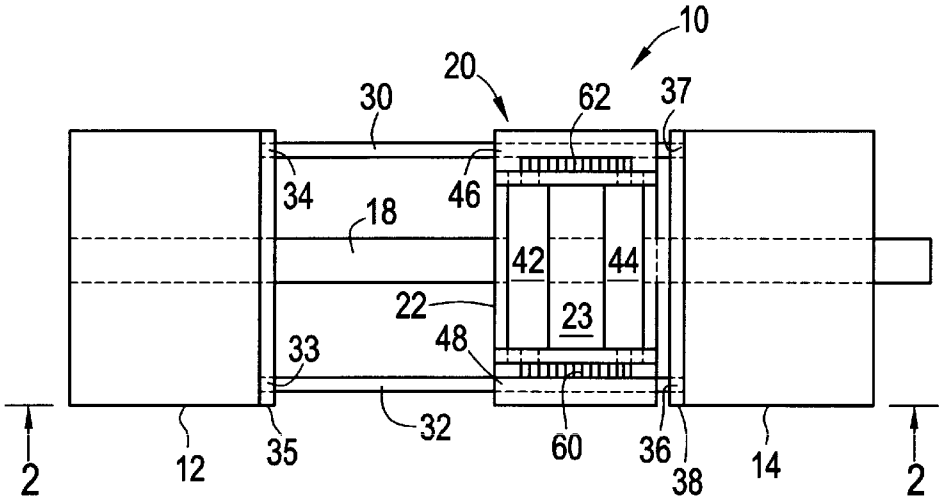
FIG. 1 is a top plan view of a device for remotely operating a handle of a circuit breaker.
Figure 2:
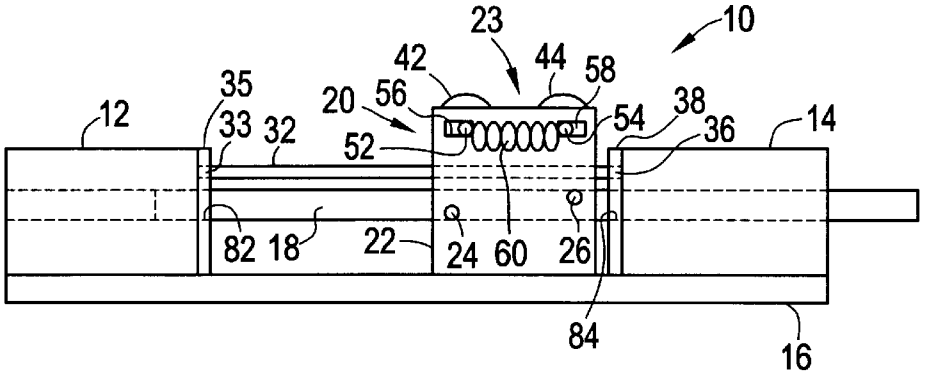
FIG. 2 is a view across lines 2—2 of FIG. 1.
Figure 4:
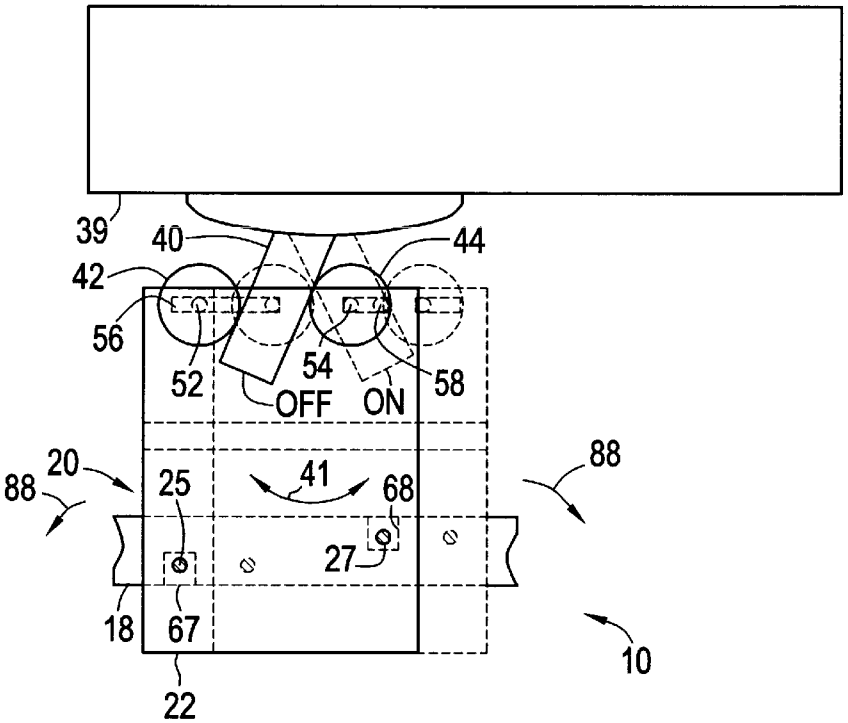
FIG. 4 is a view along lines 4—4 of FIG. 3.
Figure 3:
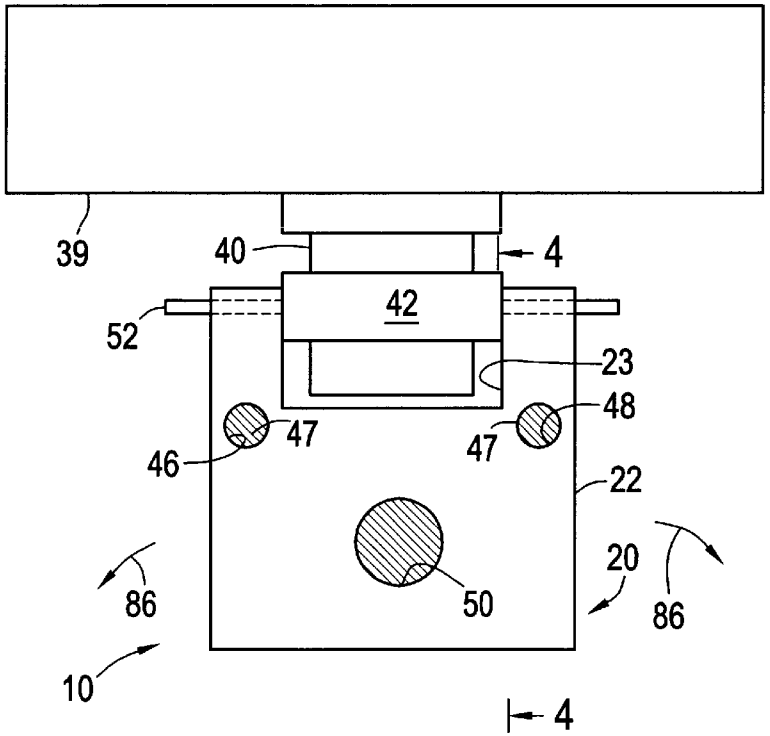
FIG. 3 is a cross section view of a body portion which manipulates a handle of a circuit breaker.
Figure 5:
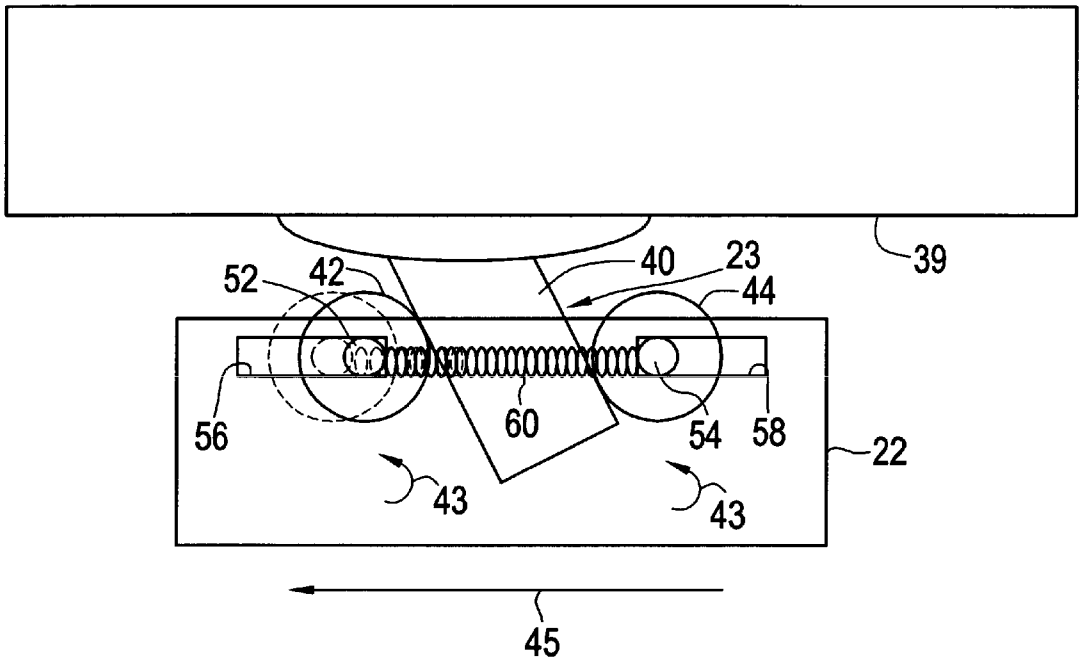
FIG. 5 is an enlarged view of a portion of FIG. 4.
Figure 6:
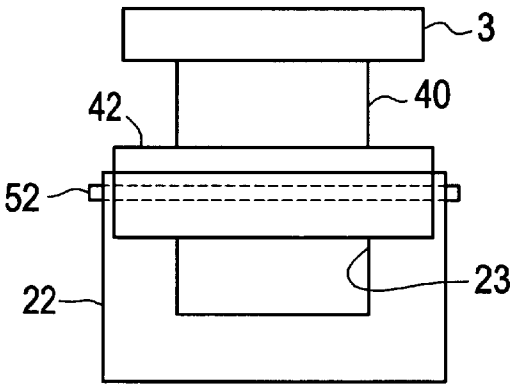
FIG. 6 is an enlarged partial view of the body portion of FIG. 3.

Referring to FIGS. 1–6, a device 10 for remotely operating a handle 40 of a circuit breaker 39 is shown. Device 10 includes a moving body 20 that interfaces with handle 40 for manipulation of handle 40 between a "TRIPPED" and an "OFF" position, between an "ON" and the "OFF" position, between the "OFF" and the "ON" position, and/or between the "TRIPPED" and the "ON" position. The various positions of handle 40 correspond with the status of circuit breaker 39 current flow therethrough.

One example of circuit breaker 39 is a circuit breaker that utilizes a movable contact arm assembly to carry a current. The movable contact arm assembly is typically separated from a complementary stationary contact by electromagnetic forces that overcome the holding force of contact springs (i.e., blow open forces), or, by other short-circuit conditions that signals an actuator to cause an operating mechanism to separate the contact via powerful mechanism operating springs and various links. During quiescent operation, handle 40, which is attached to the operation mechanism, is in the "ON" position. To separate the contacts, an operator or a remote operating device such as device 10 moves handle 40 to the "OFF" position.

After the movable contact arm assembly is separated from the stationary contact, and the short-circuit condition is cleared, the electrical contact between the stationary and movable contacts must be closed and the operating mechanism reset. If the contact arm assembly separates via blow open forces, handle 40 remains in the "ON" position, unless the short-circuit condition also causes the actuator to trigger the operating mechanism, whereby handle 40 is in the "TRIPPED" position. Also, if the contact arm assembly separates via the operating mechanism, handle 40 moves to the "TRIPPED" position, which is generally between the "ON" and the "OFF" postions.

In the above situations where the contact arm assembly is separated, no current flows through the circuit breaker. Typically, to reset circuit breaker 39, handle 40 must be moved to the "OFF" position. To reposition the contact arm assembly in electrical contact with the stationary contacts, handle 40 is moved to the "ON" position.

Moving body 20 includes a slide block 22. Slide block 22 is formed of a sturdy material such as plastic which is easily molded and has a receiving area 23 on the upper surface of slide block 22. Receiving area 23 is large enough to receive a portion of handle 40 of circuit breaker 39. Receiving area 23 includes a pair of rollers 42 and 44 that provide the mechanical interface with handle 40. When slide block 22 is actuated in the direction indicted by arrow 45 (FIG. 5), rollers 42 and 44 interface handle 40 and rotate (as indicated by arrows 43) and minimize friction between rollers 42 and 44 and handle 40.

Rollers 42 and 44 are constructed of a hard, durable material, preferably with a high lubricity, such as brass. Rollers 42 and 44 are mounted to slide block 22 with a pair of pins 52 and 54 passing through rollers 42 and 44, respectively. Each end of pins 52 and 54 are received and supported within openings 56 and 58 on each side of slide body 22. A pair of extensions springs 60 and 62 are secured to a pins 52 and 54 at one end and the side of slide body 22 opposite to rollers 42 and 44 at the other end.

Springs 60 and 62 provide sufficient compression so as not to extend during normal movement of handle 40 by slide block 22. However, extension is desired to prevent stresses generally within device 10 if slide block 22 is actuated under circumstances where handle 40 does not move in the direction of actuation, for example, in the event of a circuit breaker mechanism or handle jam, or during over travel, wherein force is applied through slide block 22 when handle 40 is at a travel limit.

Openings 56 and 58 are elongated to allow for extension and contraction of springs 60 and 62. The arrangement of rollers 42 and 44 and pins 52 and 54 provides latitude for outward movement. This is useful, for example, in the event of a circuit breaker mechanism or handle jam, or during over travel, wherein increased force is applied to handle 40 through rollers 42 and 44 due to movement of slide block 22 causes friction between rollers 42 and 44, and handle 40, to increase.

The increased friction in turn prohibits (partially or wholly) rotation of rollers 42 and 44. Thus, the force due to movement of slide block 22 is translated through pins 52 and 54 and causes extension of springs 60 and 62. When the force due to movement of slide block 22 is in the direction indicated by arrow 45 in FIG. 5, and rotation of rollers 42 and 44 are prohibited, roller 42 moves outwardly (as partially shown with phantom lines in FIG. 5) as springs 60 and 62 extend and allow pin 52 to separate from the edge of opening 56.

Slide block 22 has an opening 50 for receiving a shaft 18. Shaft 18 is fixedly secured to slide block 22 with a pair of pins 24 and 26 inserted through openings 25, 27, respectively, on one side of slide block 22, and through notches 67 and 68, on the top and bottom portions of shaft 18, respectively.

Shaft 18 having slide block 22 secured thereto moves between a first position and a second position (shown in FIG. 4 by phantom lines), generally corresponding with or exceeding the range defined by the "ON" and "OFF" positions of handle 40 of circuit breaker 39. The forces that drive shaft 18 are electromagnetic forces provided from either or both a first coil 12 and a second coil 14. Coils 12 and 14 are mounted to a common baseplate 16 and are spaced a distance apart from each other. This distance accommodates the range of motion required for slide block 22 to move handle 40 between the on and off positions. Thus, as shaft 18 is actuated by either or both coils 12 and 14, moving body 20 follows the movement of shaft 18 and actuation of handle 40 is achieved.

The dimensions and positioning of slide block 22 allow for additional support from baseplate 16. This is particularly useful when slide block 22 pushes one or more circuit breaker handles, as described further herein. Baseplate 16 is any suitable material for mounting coils 12 and 14, such as a plastic material, so as not to interfere with the electromagnetic field created by coils 12 and 14. Furthermore, the material of baseplate 16 should minimize friction between baseplate 16 and slide block 22. Optionally, a lubricant can be applied to or integrally formed within baseplate 16 and/or slide block 22.

A pair of guide pins 30 and 32 received in pin openings 46, 48, respectively, through slide block 22, and are supported at one ends by pair of openings 33 and 34 in a block 35 and at the opposite end by a pair of openings 36 and 37 in a block 38. Pin opening 46 and 48 are large enough to allow pins 30 and 32 to slide through. Guide pins 30 and 32 minimize or eliminate torsional rotation of moving body 20 (in the general direction indicated by arrows 86 in FIG. 3). The load created by rollers 42 and 44 pushing on circuit breaker handle 40 is partially absorbed by pins 30 and 32 upon which slide block 22 rides. Furthermore, guide pins 30 and 32 prevent tilting of moving body 20 (in the general direction indicated by arrows 88 in FIG. 4) due to friction build up between baseplate 16 and the bottom surface or an edge of slide block 22 during movement of shaft 18 (e.g., when slide block 22 is dimensioned and positioned for support from baseplate 16, as described above). Openings 46 and 48 can also include bushings 47 and 49, respectively, to reduce friction between openings 46 and 48, and guide pins 30 and 32. Blocks 35 and 38 are mounted to the facing surfaces of coils 12 and 14, respectively. Blocks 35 and 38 are constructed of a plastic material (so as not to interfere with the electromagnetic fields of coils 12 and 14). In addition, blocks 35 and 38 each have an opening 82 and 84 large enough to allow shaft 18 to slide through.

Figure 7:
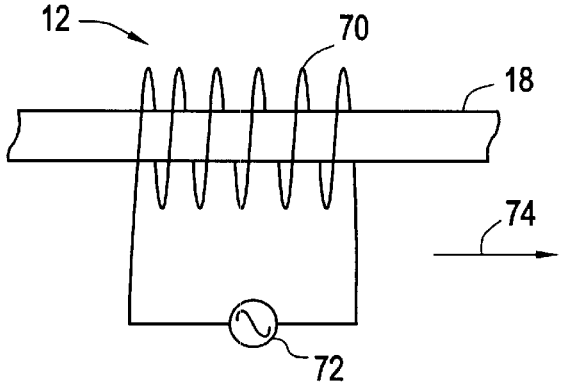
FIG. 7 is a schematic of a coil which provides an electromagnetic force to move the body portion.

Coils 12 and 14 are generally electromagnetic coils within solenoids. Referring now also to FIG. 7, coil 12 is shown having shaft 18 passing through the center of coil 12. Coil 14 is generally identical to coil 14, although variation is tolerable, and may be desired in certain situations, for example, where a different force is required to move handle 40 in different directions. Coil 12 includes a plurality of windings 70 connected at each end to positive and negative terminals of a power source 72. Power source 72 is switched on and off by a wired or wireless device (not shown), whereupon current passes through windings 70 of coil 12 and an electromagnetic force is generated to drive shaft 18 in the direction indicated by arrow 74. In coils such as depicted in FIG. 7, where shaft 18 is in direct electromagnetic communication with coil 12, shaft 18 is constructed of a ferrous material so as to be driven by the electromagnetic force. Suitable solenoids for use as coils 12 and 14 include the P/Q500 series solenoids, commercially available in various dimensions and power handling capabilities from Trombetta Electromagnetics, Menomonee Falls, Wis.

The design and placement of coils 12 and 14 allows for forces to be provided to move shaft 18 back and forth as a current flows through the windings of either coil 12 or 14. Coils 12 and 14 are enabled and disabled of power for example with separate connection to an outside power source such as power source 72. Generally, where both coils 12 and 14 the same type of solenoid (e.g., both similar to coil 12 in FIG. 7), coil 12 provides a force in a direction opposite to the force applied by coil 14. This action allows for a very quick movement of a circuit breaker handle between the "TRIPPED" and the "OFF" position, between the "ON" and the "OFF" position, between the "OFF" the and "ON" position, and/or between the "TRIPPED" and the "ON" position. Further, the design of receiving area 23 allows the force provided by coils 12 or 14 to remain fairly linear as handle 40 is moved in a radius (shown by arrow 41 in FIG. 4) between the "OFF" position of the "ON" position (shown in solid and phantom lines, respectively).

In addition to the above embodiments, alterative embodiments are also detailed, wherein similar elements are numbered in increments of one-hundred as compared to the similar elements in the preferred embodiments described with reference to FIG. 1–7.

Figure 8:
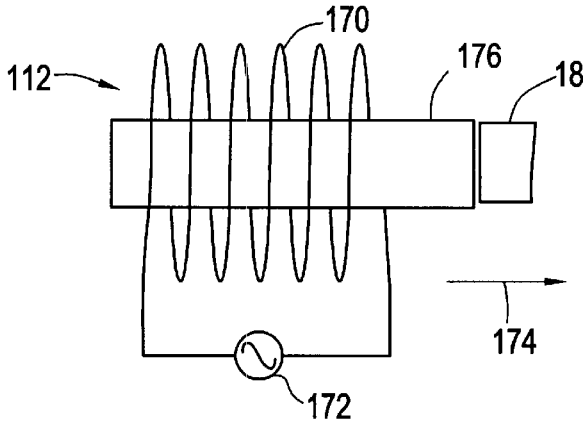
FIG. 8 is a schematic of an alternative coil.

Alternatively, and referring now to FIG. 8, a coil 112 is provided as a substitute for either or both coils 12 and 14. Coil 112 includes a plurality of windings 170 electrically connected to a power source 172, generally similar to coil 12 detailed in FIG. 7. A plunger 176 is included generally in the center of coil 112, having windings 170 arranged around plunger 176. Plunger 176 is positioned adjacent to shaft 18 to transmit motion when an electromagnetic force is generated that drives plunger 176 in the direction indicated by arrow 174. Plunger 176 may also be coupled to shaft 18 (not shown). In coils such as depicted in FIG. 8, where shaft 18 is separate from coil 112, shaft 18 is constructed of a plastic material so as not to interfere with the electromagnetic fields of coils 112, and plunger 176 is of a ferrous material so as to be driven by the electromagnetic force.

Figure 9:
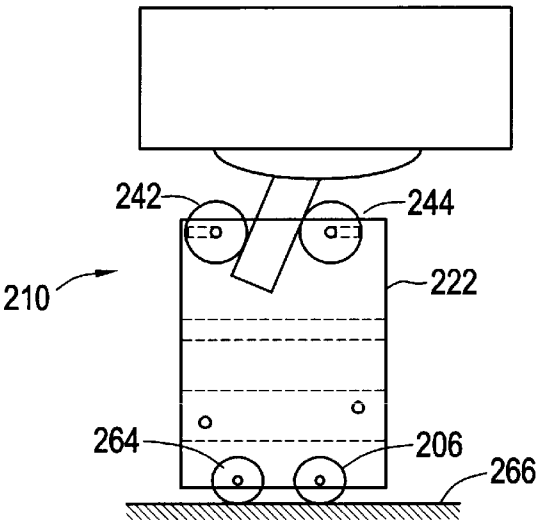
FIG. 9 is a side view of an alternative body portion.

Another alternative embodiment is provided by a device 210 shown in FIG. 9. A second set of rollers 264 and 266 are mounted on a slide block 222 on the side opposite a pair of rollers 242 and 244. Rollers 264 and 266 interact with a baseplate 216 to provide further anti-rotation resistance. By using rollers 264 and 266, the anti-rotation action is achieved without substantially increasing the frictional loading on slide block 222.

Figure 10:
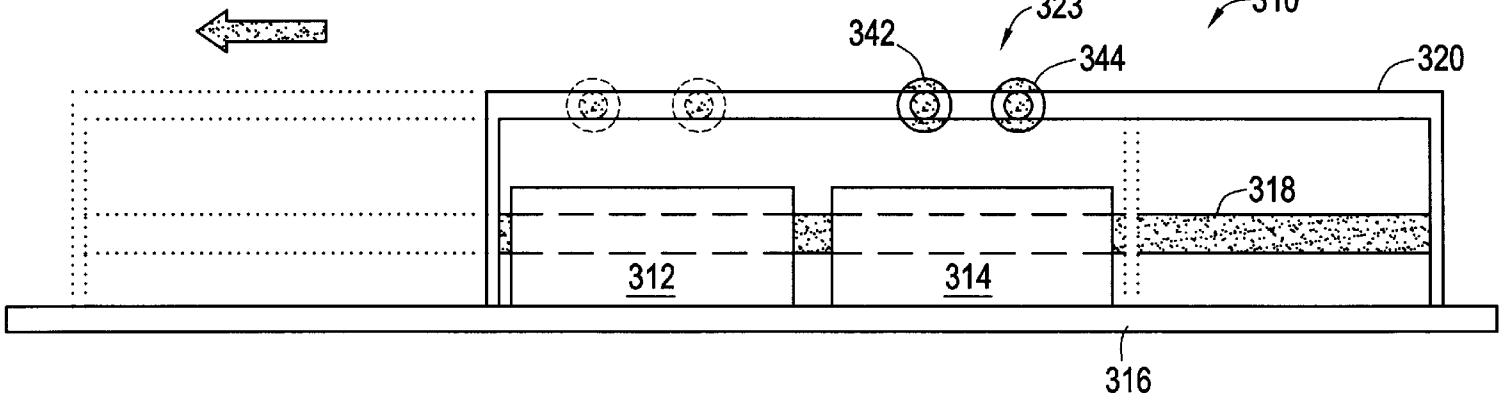
FIG. 10 is a side view of an alternative device for remotely operating a handle of a circuit breaker.

Still another alternative embodiment of a remote operating device 310 is shown in FIGS. 10. Device 310 and includes a baseplate 316, generally as described above, having a first and second coil 312 and 314 secured thereto. A common shaft 318 passes through coils 312 and 314. Shaft 318 is attached to a body 320 at one end of shaft 318 (not shown) or both ends of shaft 318. Body 320 generally interfaces one or more circuit breaker handles (not shown) via a receiving area 323 having a pair of rollers 342 and 344 (and optionally a second set of rollers similar to rollers 264, 266 shown in FIG. 9). Body 320 may be partially or wholly enclosed, for example to provided various levels of support or for aesthetic purposes. The position of body 320 after movement due to the electromagnetic forces of either coil 312 or 314 is shown by phantom lines.

Figure 11:
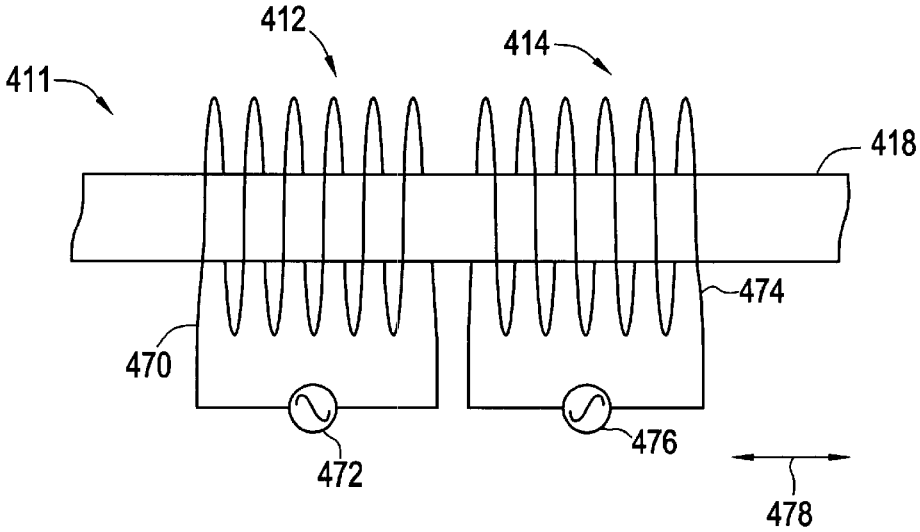
FIG. 11 is a schematic of an alternative coil which provides an electromagnetic force to move the body portion.

In yet another alternative embodiment, and referring now to FIG. 11, a solenoid 411 is used in place of a pair of coils. For example, solenoid 411 may replace coils 312 and 314 used in device 310. Solenoid 411 is a push-pull type, wherein electromagnetic forces are provided in opposite linear directions, as indicated by an arrow 478. A pair of coils 412 and 414 are provided around a shaft 418. Coil 412 includes windings 470 electrically coupled to a power source 472, and coil 414 includes windings 474 electrically coupled to a power source 476. The polarities of the connections between windings 470 and power source 472, and windings 474 and power source 476, are inverted. Therefore, coils 412 and 414 can be energized individually to either provide a force in a first direction to "pull" shaft 418, or to provide a force in a second direction opposite the first direction to "push" shaft 418.

Figure 13:
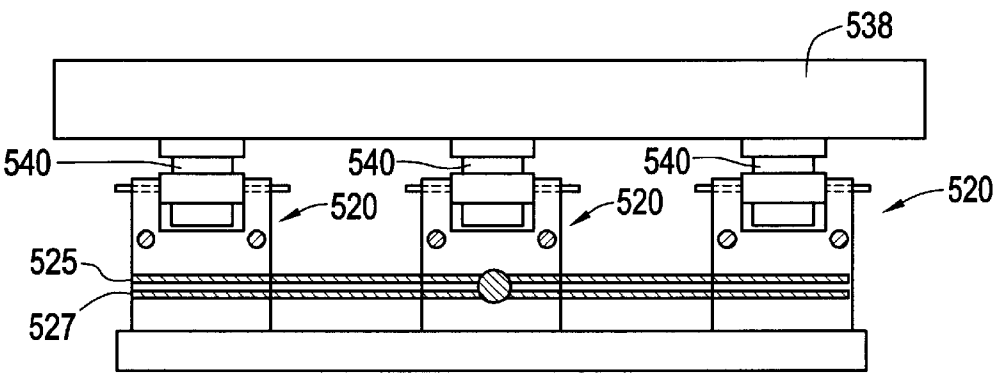
FIG. 13 is a view across lines 13—13 of FIG. 12.
Figure 12:
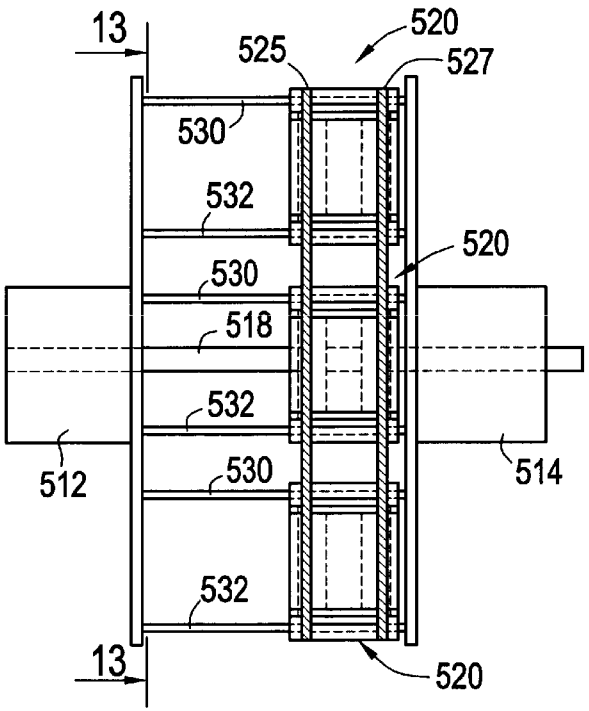
FIG. 12 is a top plan view of an alternative device for remotely operating a plurality of handles of a multiple pole circuit breaker.

In an additional alternative embodiment, and referring now to FIGS. 12 and 13, a device 510 is used with a multiple pole circuit breaker 539 having a plurality of handles 540. A plurality of moving bodies 520 are interconnected through pins 525 and 527, which are also used to secure the central moving body 520 to a shaft 518. Moving bodies 520 are guided by a plurality of sets of guide pins 530, 532. A pair of coils 512 and 514 are arranged on a base 516 for providing electromagnetic forces to move shaft 518.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A device for operating a circuit breaker handle comprising:

a body having a receiving area, said body being fixedly secured to a shaft for movement between a first position and a second position, and said receiving area being configured and dimensioned to receive and engage a portion of said circuit breaker handle; a first coil and a second coil, said first coil for generating a first electromagnetic force in a first direction and said second coil for generating a second electromagnetic force in a second direction, said second direction being opposite to said first direction, wherein, when said first coil is generating said first force, said shaft is moved in said first direction moving said body to said first position and when said second coil is generating said second force, said shaft is moved in said second direction moving said body to said second position.

2. The device as in claim 1, wherein said shaft is configured for linear movement.

3. The device as is claim 1, further comprising:

a first roller and a second roller rotatably configured and positioned for receiving said portion of said circuit breaker handle.

4. The device as in claim 3, wherein said first roller is rotatably arranged on a first pin and said second roller is rotatably arranged on a second pin, said device further comprising:

a first spring extended between said first pin and said second pin proximate to a first side of said first roller and said second roller, and a second spring extended between said first pin and said second pin proximate to a second side of said first roller and said second roller.

5. The device as in claim 4, wherein said first pin and said second pin are supported in elongated openings in said body.

6. The device as in claim 3, further comprising a base for mounting said first coil and said second coil, and wherein said body further comprises a third roller rotatably configured and positioned for interfacing said base.

7. The device as in claim 1, wherein said body is secured to said shaft between said first coil and said second coil.

8. The device as in claim 1, wherein said body is secured to said shaft outside of said first coil and said second coil.

9. The device as in claim 1, wherein said first coil and said second coil each comprise push-type solenoids.

10. The device is in claim 1, wherein said first coil and said second coil are both within a push-pull type solenoid.

11. In combination, a circuit breaker having a handle, movable from an on position to an off position, and a device for operating the handle, the device comprising:

a body having a receiving area, said body being fixedly secured to a shaft for movement between a first position and a second position, and said receiving area being configured and dimensioned to receive and engage a portion of said handle; a first coil and a second coil, said first coil for generating a first electromagnetic force in a first direction and said second coil for generating a second electromagnetic force in a second direction, said second direction being opposite to said first direction, wherein, when said first coil is generating said first force, said shaft is moved in said first direction moving said body to said first position and when said second coil is generating said second force, said shaft is moved in said second direction moving said body to said second position.

12. The combination of claim 11 wherein the device further comprises a first roller and a second roller rotatably configured and positioned for receiving said portion of said handle.

13. The combination of claim 12 further comprising a base for mounting said first coil and said second coil and wherein said body further comprises a third roller rotatably configured and positioned for interfacing said base.

14. The combination of claim 11 wherein said body is secured to said shaft between said first coil and said second coil.

15. The combination of claim 11 wherein said body is secured to said shaft outside of said first coil and said second coil.

16. The combination of claim 11 wherein said circuit breaker is a multipole circuit breaker having a plurality of handles, and wherein said device includes a body for each of said plurality of handles, each body fixedly secured to said shaft.

17. A system for remote operation of circuit breaker handles, the system comprising:

a circuit breaker having a handle, movable from an on position to an off position;

a handle operating device for operating the handle, the handle operating device comprising a body having a receiving area, said body being fixedly secured to a shaft for movement between a first position and a second position, and said receiving area being configured and dimensioned to receive and engage a portion of said handle; a first coil and a second coil, said first coil for generating a first electromagnetic force in a first direction and said second coil for generating a second electromagnetic force in a second direction, said second direction being opposite to said first direction, wherein, when said first coil is generating said first force, said shaft is moved in said first direction moving said body to said first position and when said second coil is generating said second force, said shaft is moved in said second direction moving said body to said second position; and, a remote programming device for providing a signal to the handle operating device.

18. The system of claim 17 wherein the handle operating device further comprises a first roller and a second roller rotatably configured and positioned for receiving said portion of said handle.

19. The system of claim 18 further comprising a base for mounting said first coil and said second coil and wherein said body further comprises a third roller rotatably configured and positioned for interfacing said base.

20. The system of claim 17 wherein said circuit breaker is a multipole circuit breaker having a plurality of handles, and wherein said handle operating device includes a body for each of said plurality of handles, each body fixedly secured to said shaft.

* * * * *